US005546993A

United States Patent [19]

Summey, III et al.

[11] Patent Number: 5,546,993

[45] Date of Patent: Aug. 20, 1996

[54] WEB TENSION APPARATUS WITH SENSOR SWITCH ARRANGEMENT FOR OSCILLIATING DANCER ROLL AND METHOD

[75] Inventors: Shala W. Summey, III, Greenville; William J. Alexander, III, Mauldin, both of S.C.

[73] Assignee: Alexander Machinery, Inc., Mauldin, S.C.

[21] Appl. No.: 292,872

[22] Filed: Aug. 19, 1994

[51] Int. Cl.[6] ..... D03D 49/20

[52] U.S. Cl. ..... 139/311; 242/413.5; 242/542; 226/44

[58] Field of Search ..... 242/413.5, 413.6, 242/542, 554, 563.2; 139/309, 311, 310; 226/44

[56] References Cited

U.S. PATENT DOCUMENTS

| | | | |
|---|---|---|---|
| 3,164,332 | 1/1965 | Walker et al. | 242/542 |
| 3,365,143 | 1/1968 | Espel | 242/413.5 |
| 3,953,713 | 4/1976 | Deligt | 242/201 |
| 4,216,804 | 8/1980 | Alexander III et al. | 242/413.5 |
| 5,170,611 | 12/1992 | Buchko et al. | 226/44 |
| 5,259,421 | 11/1993 | Alexander, III et al. | 226/44 |
| 5,299,753 | 4/1994 | Alexander, III | 242/413.5 |
| 5,314,128 | 5/1994 | Alexander, III | 242/542 X |
| 5,356,334 | 10/1994 | Gray | 454/51 |

*Primary Examiner*—Andy Falik
*Attorney, Agent, or Firm*—Ralph, P.A. Bailey

[57] ABSTRACT

A web tension control apparatus and method utilizes a control for a drive motor (A) including an oscillating roll (B) for moving a cam (C) in relation to a proximity sensor (E) for controlling the tension in the moving web being transported for takeup. The power output of the proximity sensor is transmitted for controlling the output of a motor by control circuit (D) for maintaining the tension in the moving web within desirable limits.

16 Claims, 4 Drawing Sheets

WEB TENSION APPARATUS WITH SENSOR SWITCH ARRANGEMENT FOR OSCILLIATING DANCER ROLL AND METHOD

BACKGROUND OF THE INVENTION

This invention relates to apparatus and method for controlling tension in a moving web and especially to an improvement in the tension control apparatus of U.S. Pat. No. 4,216,804.

Loom tension control apparatus illustrated in the above patent contemplates the use of an oscillating roll which is carried by the fabric so as to be raised and lowered as tension/speed increases and decreases in the fabric. The oscillating roll is positioned in a horizontal run of the fabric where a change in direction of the fabric occurs. The force exerted by the roll on the fabric may be varied as through the use of a counterweight or a spring so as to adjust the effective weight of the roll and hence the force exerted by gravity against the cloth to provide desirable tension in the fabric being fed to the takeup. Oscillation of the roll carried by the fabric is transmitted through a suitable drive including a chain or the like to a potentiometer or auto- transformer. The continuous oscillations occurring during weaving, produces constant movement and hence wear on all these mechanical parts.

A major problem in the tension control apparatus of devices constructed in accordance with the above patent as well as other similar devices results from wear on the moving parts.

Moreover, adjustment of the various mechanical parts requires manipulation of several components. The range of adjustment for a given movement of the oscillating roll is limited.

SUMMARY OF THE INVENTION

Accordingly, it is an important object of the present invention to reduce wear upon mechanical parts which may include chains, sprockets and autotransformers in apparatus provided for controlling the tension in a textile web and the like.

Another important object of the invention is to provide for an increased range and accuracy of speed control for the apparatus while increasing the sensitivity and reducing the required movement of the apparatus in order to effect the necessary control and adjustments upon tension in the web.

Another object of the invention is to provide an improved tension control apparatus and method which is especially useful in controlling the tension in fabric coming from a machine such as a loom used in the manufacturing process for the fabric and which is being transported to a takeup such as a surface wound fabric or web roll.

Apparatus constructed in accordance with the invention utilizes a cam and the like which is moved in response to an oscillating member over which the cloth passes in order to reflect variations in tension, and includes a proximity switch for producing an electrical output indicative of tension or speed in the web for operating a motor control circuit for controlling the speed of the motor to produce desired tension in the fabric.

An important advantage achieved by apparatus constructed in accordance with the invention is elimination of the need for a mechanical coupling of a potentiometer and the like to a rotating drive member, thereby minimizing maintenance and repair because there are few moving mechanical parts to cause wear. Adjustments of the cam may be readily made, as for example, by rotating the cam or moving the proximity sensor or by substituting another cam of a different configuration. In some cases, tension control devices are moved on every pick of the loom resulting in increased wear to the moving parts including the autotransformer or potentiometer.

While the invention is described in connection with a loom takeup utilizing a surface wound takeup roll, it is to be understood that the apparatus and method of the invention is also useful in connection with center wound loom takeups as well as in other applications where it is desirable to control tension in a moving web.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate tension control apparatus for use in a takeup driven by a motor A receiving a textile fabric from a loom manufacturing the fabric constructed in accordance with the invention. The fabric is moved over an oscillating roll B for changing the direction of the fabric and producing oscillatory movement of the roll in response to variations in tension in the fabric during manufacturing and winding. A cam C is moved in response to the oscillatory movement of the roll. A motor control circuit D supplies power to and controls the speed of the motor. A proximity sensor E in the motor circuit is mounted in operable relation to the cam producing variations in power varying the speed of the motor in response to movements of the cam varying the tension imparted to the fabric. Thus, tension in the fabric delivered to the takeup is controlled by a cam moved in response to movement of a roll over which said fabric passes during manufacturing.

The apparatus incorporates a linear analog proximity inductance sensor E, along with a cam C and a solid state motor control circuit including either a D.C. or an A.C. invertor.

The cam C may be arcuate and the distance to the proximity sensor may vary as the cam rotates. As the distance increases the signal from the linear analog sensor increases also, therefore increasing the motor speed responsive to the motor control circuitry D. In some instances some linear analog sensors may decrease the signal as the distance increases.

Figure 1:
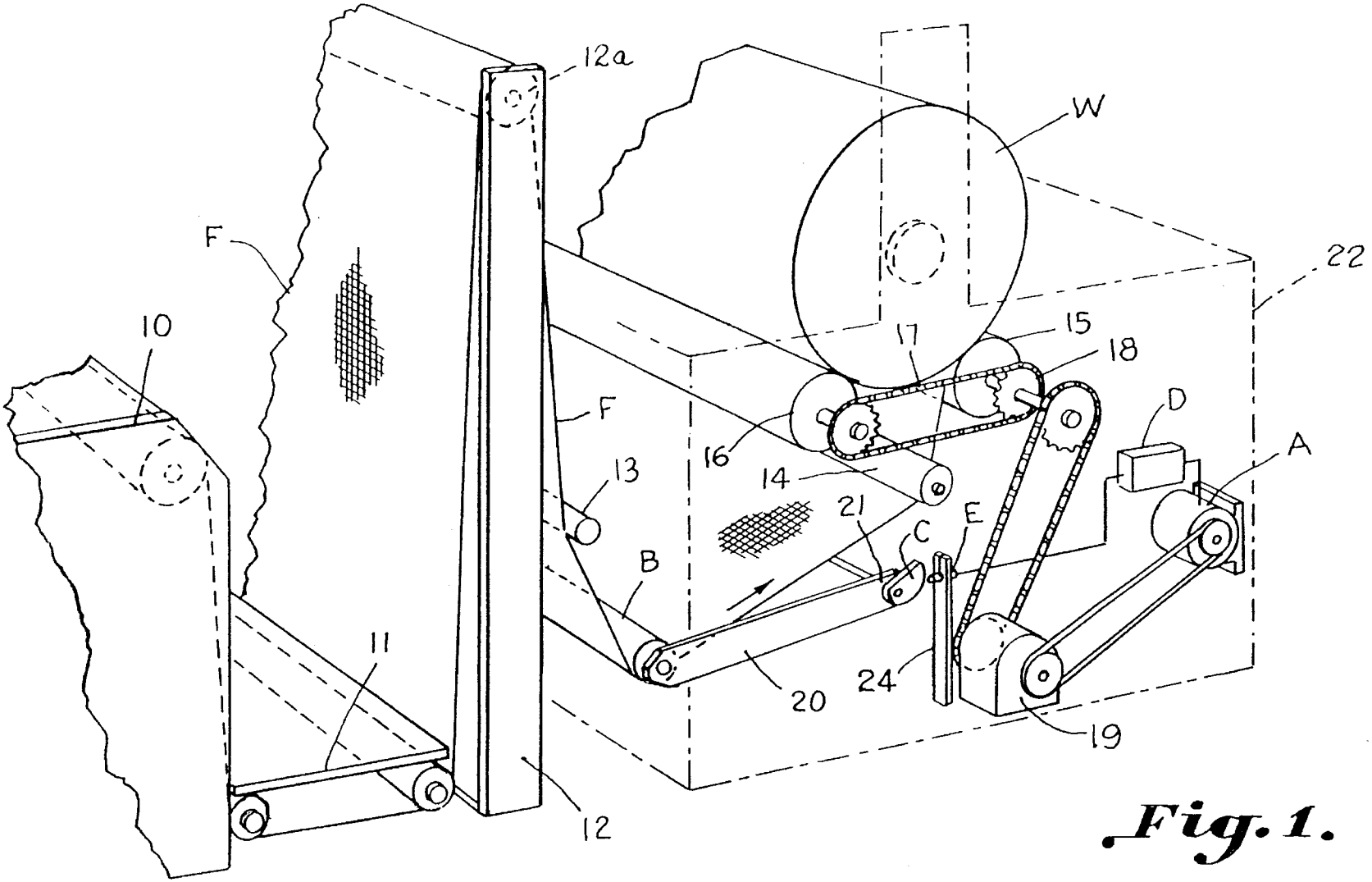
FIG. 1 is a perspective view illustrating apparatus for inspecting and taking up cloth from a loom upon a surface winder including an oscillating roll carried in a substantially horizontal run of fabric at a location where there is a change in direction of the fabric, produces movement of a cam in relation to a proximity switch for controlling the speed of a drive motor.

Referring more particularly to FIG. 1, a web in the form of fabric F is delivered from a loom 10, where it has been manufactured, and thence beneath an operator's platform 11. The fabric F passes on an upward path on an inspection stand 12 and thence on a downward path as to a guide roll 13. The fabric F passes over an oscillating roll B and thence in a substantially horizontal run over a guide roll 14. The fabric passes over the guide roll 14 and over a driven support roll 15 of a takeup illustrated as a surface winder. The surface winder includes a second roll 16 which is suitably driven by a chain 17 from a sprocket 18 carried by the driven roll 15. The cloth is then wound upon a surface wound cloth roll W. The motor A is illustrated as driving the support roll 15 through a gear box 19 or other power transmission means.

The oscillating roll B is illustrated as a transverse compensator roll pivotally carried by compensator arms 20 on a control shaft 21 which is carried for rotation in a suitable frame 22 illustrated in broken lines. The shaft 21 carries a cam C which is adjustably positioned thereon as by a set screw 23 in FIG. 2 in operating relation to a proximity switch E. The proximity sensor E may be mounted for suitable adjustment in respect to said cam upon a support 24. The proximity sensor E transmits power to the motor control circuit D responsive to said cam producing variations in power supplied to the motor A in response to movements of the cam varying the tension imparted to the fabric.

Figure 2:
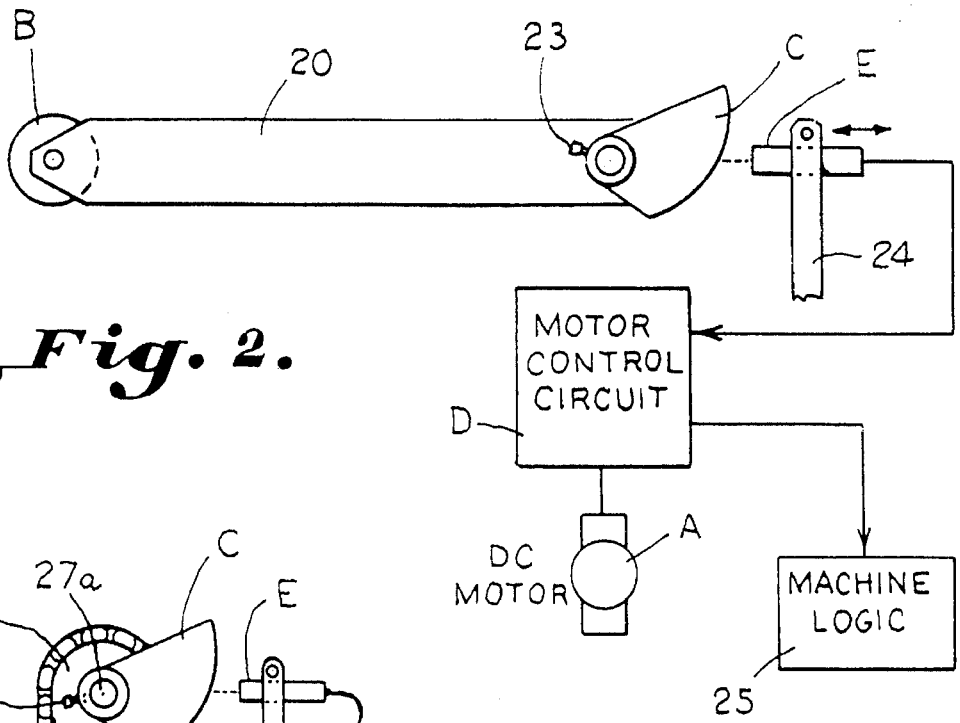
FIG. 2 is an enlarged side elevation further illustrating the oscillating roll and tension control apparatus of FIG. 1.

The output from the proximity sensor E controls the motor control circuit D illustrated schematically in FIG. 2. The motor control circuitry D controls the speed of the motor A as well as any desirable machine logic components 25 which may include limit switches, direction controls and stop motion for the loom as well as the takeup.

Figure 3:
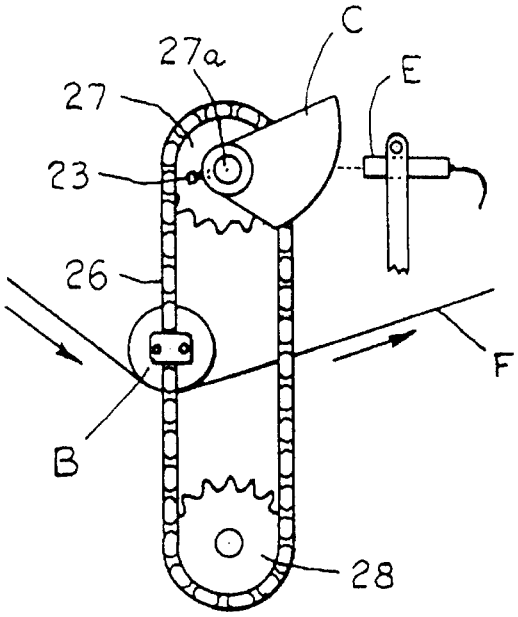
FIG. 3 is a side elevation illustrating a modified form of the invention wherein a dancer roll over which the fabric is passed drives a cam for rotation in relation to a proximity switch for controlling tension in the fabric.

A modified form of the invention is illustrated in FIG. 3 wherein the oscillating member is provided in the form of a dancer roll B over which passes the fabric F. The dancer roll is illustrated as being carried by a chain 26 which in turn is carried by sprockets 27 and 28. The sprocket 28 is mounted upon a control shaft **27*a*** which carries a cam C for rotation for varying the distance between the cam and a proximity switch E for operating the controls described above.

Figure 4:
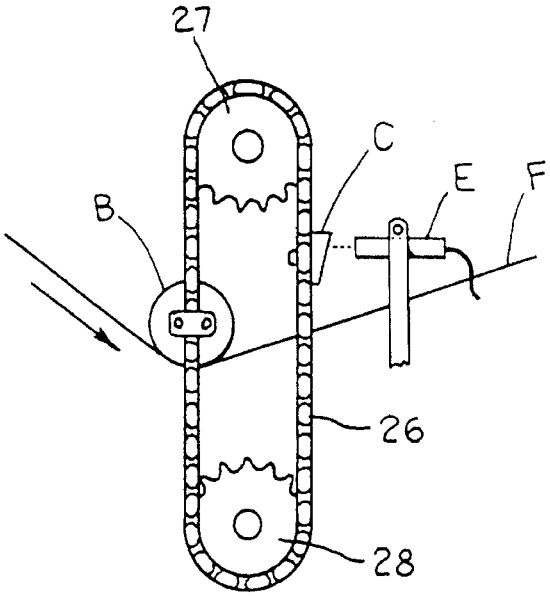
FIG. 4 is a side elevation illustrating a further modified form of the invention wherein a dancer roll moves a cam in a linear motion in relation to a proximity switch for controlling tension in the web which passes over the dancer roll.

A further modified form of the invention is illustrated in FIG. 4 wherein a dancer roll B over which the web F passes is carried by a chain 26. The chain 26 in turn carries a suitably configured cam C in linear direction for varying the distance between the cam and an adjacent proximity switch E. The proximity switch E provides an output utilized by the controls for maintaining the tension in the fabric within desirable limits.

The cam C may be carried in relation to a proximity switch E by any member which is movable in response to variations in web tension. For example, the cam need not necessarily be carried at the pivot point of the arms 20 but may be otherwise positioned on the arms or elsewhere to register variations in web tension. A further example of dancer rolls on which the cam may be advantageously positioned is the spring biased dancer roll illustrated in U.S. Pat. No. 4,146,190.

Figure 5:
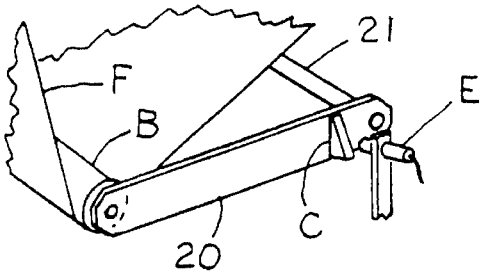
FIG. 5 is a perspective view illustrating a modified form of the invention wherein a proximity switch is positioned for actuation by the compensator arm adjacent its mounting bearing so as to be sensitive to small movements in the arm.

FIG. 5 illustrates another modified form of the invention wherein a proximity switch E is positioned for actuation by a compensator arm 20. The arm 20 is carried by the control shaft 21 at its pivot point and preferably the proximity switch E is mounted adjacent a pivot point of the compensator arm so as to be responsive to limited movement of the arm for providing the necessary control responsive to actuation by the cam C.

Figure 6:
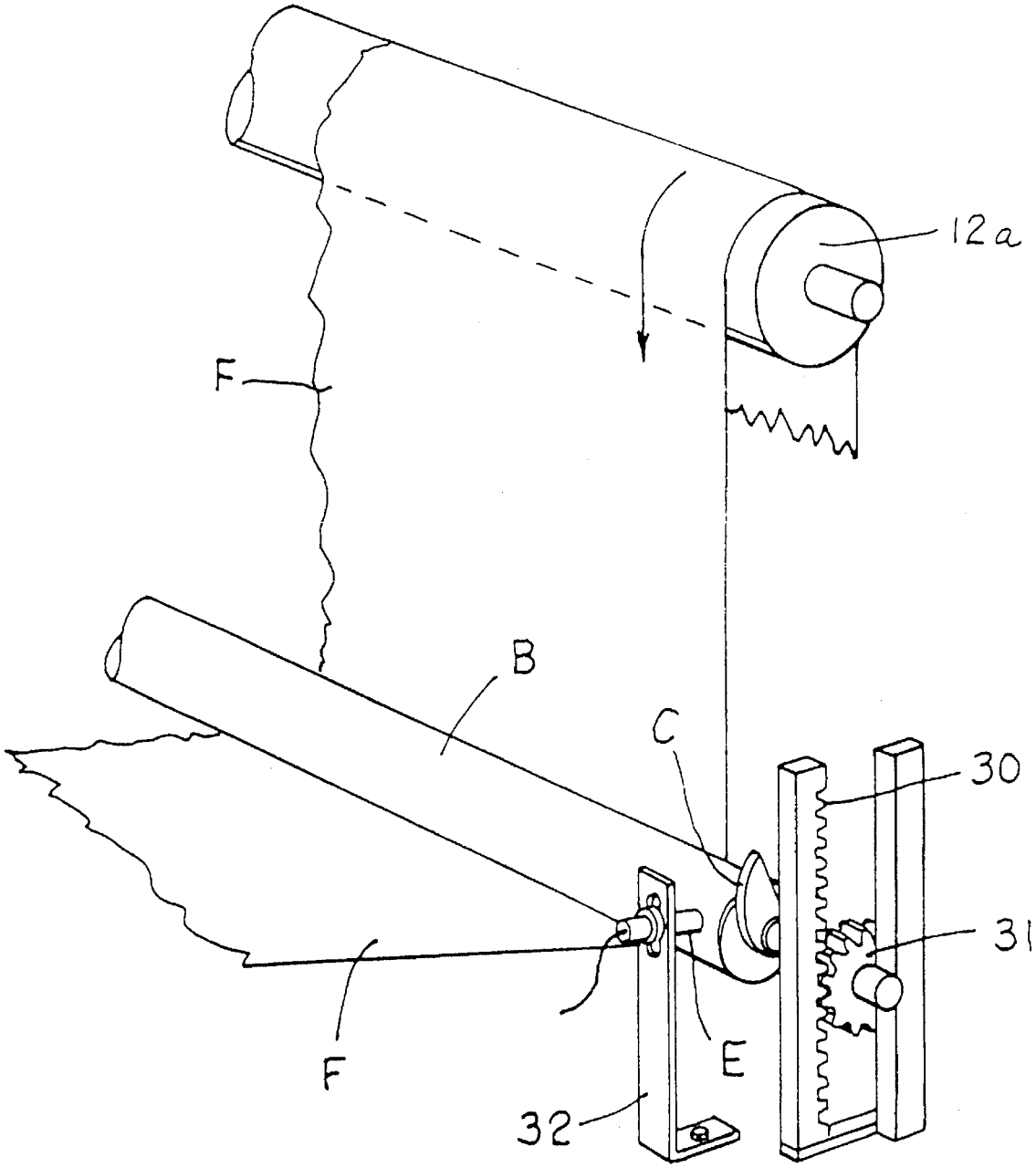
FIG. 6 is a perspective view illustrating still another modified form of the invention wherein a dancer roll over which the fabric is passed is carried by a rack and pinion for driving a cam for rotation in relation to a proximity switch for controlling tension in the fabric.
Figure 7:
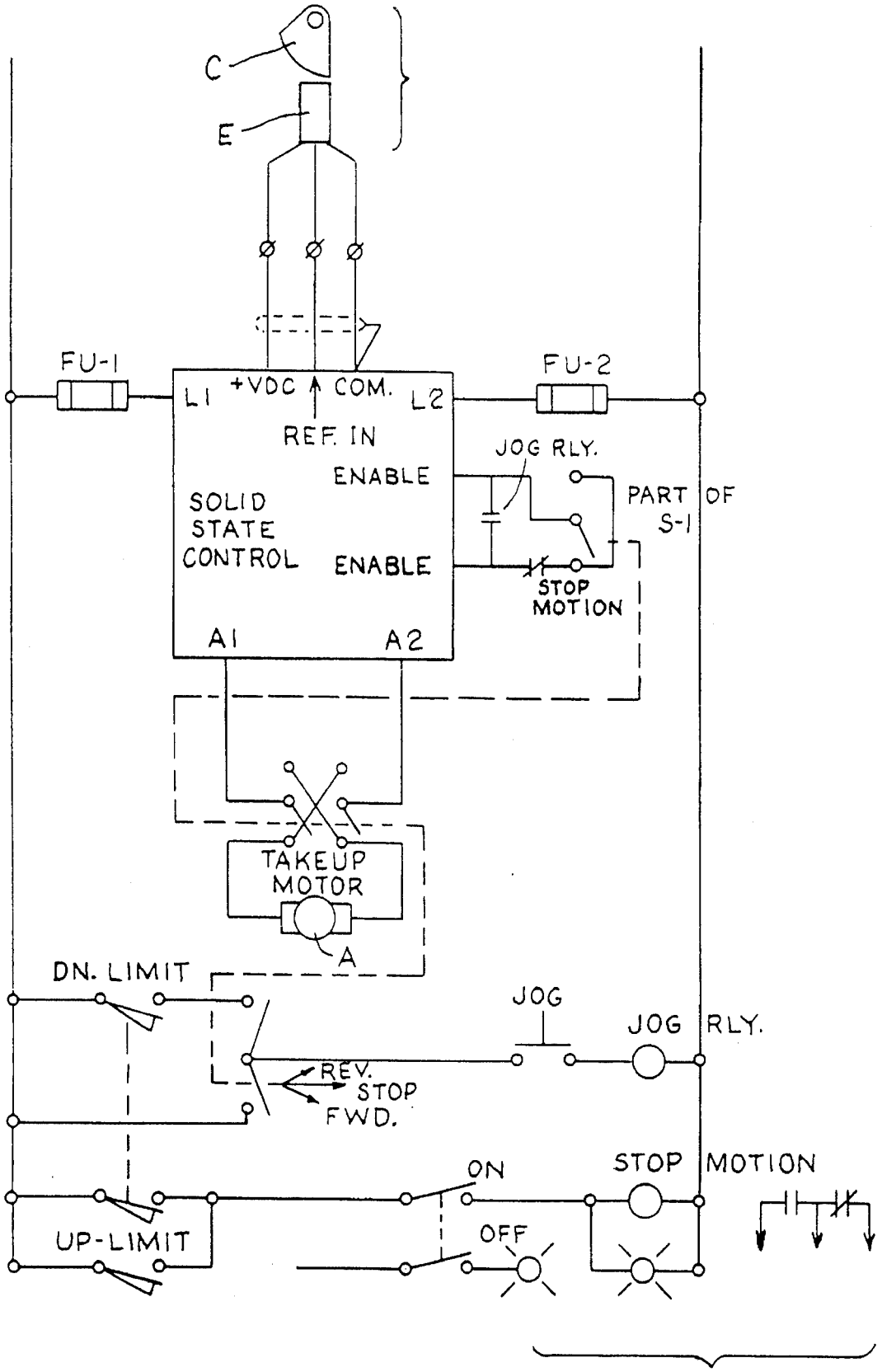
FIG. 7 is a circuit diagram illustrating the electrical components of the apparatus including a motor control circuit and controls for the logic components of a loom all operated in response to changes in the tension in a web moving a cam in relation to an inductance sensor.

FIG. 6 illustrates a further modified form of the invention wherein the fabric F passes downwardly over the roll **12*a* of the inspection stand and beneath a dancer roll B to the takeup. The dancer roll is supported by a rack 30 and a pinion 31. The cam C is rotated to actuate the proximity switch E which is supported on the bracket 32**.

In operation power is supplied to the components of the motor control circuit D including the sold state drive through the fuse FU-1 as illustrated in FIG. 6. The cam C and linear analog proximity sensor E provide a variable voltage or current to the reference input of the drive in relation to the position of the oscillating roll B. This reference voltage controls the output voltage which is thereupon transmitted for controlling the speed of the motor A.

The selector switch S-1 controls the start-stop and forward-reverse functions of the takeup. Up and down limit switches actuated responsive to oscillations of the roll B may be provided to stop the takeup and the loom in the event of trouble with either. A bypass switch is provided to run the takeup by over riding the down limit switch. Indicator lights are provided for stop and bypass modes to alert the operator. Suitable contacts are provided for control of a loom stop motion when the takeup is stopped. A jog push button is provided to jog the takeup drive in the forward or reverse direction.

It is thus seen that an improvement apparatus and method has been provided for controlling the tension in a moving web by positioning a movable roll where a change of direction is to occur and moving a cam member according to variations in tension to change the output of a proximity switch provided for sensing such movement for controlling tension. The apparatus thus provided operates with minimal moving parts avoiding maintenance and wear as occurs by the constantly moving part which occurs during a textile manufacturing operation. Ease of adjustment and accuracy in operation are also achieved.

While a preferred embodiment of the invention has been described using specific terms, such description is for illustrative purposes only, and it is to be understood that changes and variations may be made without departing from the spirit or scope of the following claims.

What is claimed is:

1. Loom tension control apparatus for use in a cloth takeup having a motor driving a pair of spaced rolls carrying a cloth roll for surface winding therebetween positioned in front of a machine from which cloth is delivered in open width to the cloth roll for winding thereon comprising:

means conveying said cloth in at least one substantially horizontal run during its delivery to the cloth roll;

means carrying said cloth on an upward path and a downward path prior to said horizontal run;

a control shaft carried for oscillation in axial alignment with said spaced rolls;

a movable roll supported by said cloth in said horizontal run, said roll being raised and lowered responsive to variations in tension in said cloth;

a pair of transversely spaced arms carrying the movable roll on one end thereof, the other end of said arms having connection with said control shaft for oscillating said control shaft responsive to variations in tension in the cloth in said horizontal run;

means carrying a cam for movement varying the position of cam in response to raising and lowering said moveable roll responsive to variations in tension in said cloth;

a motor control circuit supplying power to and controlling the speed of said motor; and a proximity sensor transmitting power to said motor control circuit responsive to the position of said cam producing variations in power supplied by said motor control circuit for varying the speed of said motor in response to movements of said cam whereby the tension imparted to said fabric is varied.

2. The structure set forth in claim 1 wherein said cam is carried by said control shaft.

3. The structure set forth in claim 1 wherein said proximity sensor is mounted adjacent one of said spaced arms adjacent said control shaft, said one of said arms carrying said cam for actuating said proximity sensor.

4. The structure set forth in claim 3 wherein said cam includes means for being adjustably mounted in relation to said proximity sensor to vary the distance therebetween and thereby vary speed adjustments to the motor.

5. The structure set forth in claim 3 wherein said control shaft carries said cam for rotation in response to movement of said oscillating roll.

6. The structure set forth in claim 5 wherein said oscillating roll is supported by said fabric in said horizontal run to said takeup and is raised and lowered in response to variations in tension in the fabric.

7. The structure set forth in claim 3 wherein said oscillating roll is a dancer roll imparting movement to said cam to reflect variations in tension in said fabric.

8. The structure set forth in claim 7 including a linear drive member;

said dancer roll being carried by said linear drive member for imparting motion thereto; and said linear drive member imparting relative motion between said cam and said proximity sensor.

9. The structure set forth in claim 7 including a linear drive member;

said dancer roll being carried by said linear drive member for imparting motion thereto;

a rotary drive member driven by said linear drive member; and said rotary drive member imparting relative motion between said cam and said proximity sensor.

10. The structure set forth in claim 7 wherein said dancer roll carries said cam and said dancer roll is supported for rotation by a rack and pinion.

11. Tension control apparatus for use in a takeup having a cloth roll driven by a motor receiving a textile fabric from a machine manufacturing said fabric comprising:

an oscillating roll over which said fabric is moved for changing direction for delivery to said cloth roll producing oscillatory movement of said roll in response to variations in tension in said fabric;

a cam adapted to be movable in response to said oscillatory movement of said roll for varying the position of said cam;

a motor circuit supplying power to and controlling the speed of said motor; and a proximity sensor supported in operable relation to said cam producing variations in said power for varying the speed of said motor in response to the position of said cam, wherein the tension imparted to said fabric is varied;

whereby tension in said fabric delivered to said takeup is controlled by said cam moved in response to movement of said roll over which said fabric passes during manufacturing.

12. The structure set forth in claim 11 wherein said proximity sensor is a linear analog proximity sensor producing variations in output responsive to variations in inductance resulting from changes in position of the cam in relation to said sensor.

13. Apparatus for controlling the tension in a moving web preparatory to winding on a web roll comprising:

an electric motor driving said web roll imparting movement and tension to a web moving in open width;

a movable roll over which said web is moved so as to change the direction of movement of the web for delivery to the web roll and to exert a force producing oscillatory movement of the roll responsive to variations in tension in the web;

a cam adapted to be moved in response to said oscillatory movement of the roll for varying the position of said cam;

a proximity sensor adjacent said cam producing variations in output in response to the position of said cam in relation to said proximity sensor reflecting variations in tension in said web;

an electrical circuit controlling the speed of said electric motor responsive to said variations in output for varying the tension imparted to said web;

whereby motor speed applying tension in a moving web may be controlled responsive to oscillations of a movable roll while minimizing moving parts.

14. A method for controlling tension in a moving web preparatory to winding on a web roll comprising the steps of:

driving said web roll utilizing an electric motor imparting tension to a web moving in open width;

passing said moving web over a movable roll so as to change the direction of movement of the web for delivery to the web roll and to exert a force producing oscillatory movement of the roll responsive to variations in tension in the web;

positioning a cam and a sensor for relative movement therebetween in response to said oscillatory movement of the roll to produce variations in the proximity of said cam to said sensor;

producing variations in output from said sensor responsive to said variations in the proximity of said cam to said sensor reflecting variations in tension in the web; and utilizing an electrical circuit controlling the speed of the electric motor responsive to said variations in output varying the tension imparted to the web;

whereby oscillations of a movable roll are utilized to control motor speed applying tension in a moving web while minimizing moving parts.

15. The method set forth in claim 14 utilizing variations in inductance resulting from changes in position of the cam in relation to said sensor for controlling the speed of said motor.

16. The method set forth in claim 14 including the step of positioning said cam for rotation upon a member carrying said movable roll.

* * * * *